United States Patent [19]

Slachetka

[11] Patent Number: 4,563,051

[45] Date of Patent: Jan. 7, 1986

[54] SHIELDED CABLE TERMINATION AND APPARATUS AND COMPONENTS THEREFOR

[75] Inventor: Joseph P. Slachetka, Ringoes, N.J.

[73] Assignee: Thomas & Betts Corporation, Raritan, N.J.

[21] Appl. No.: 651,403

[22] Filed: Sep. 17, 1984

[51] Int. Cl.[4] ..... H01R 4/18

[52] U.S. Cl. ..... 339/143 R; 339/177 R; 339/276 R

[58] Field of Search ..... 339/143, 177, 276 R, 339/276 T

[56] References Cited

U.S. PATENT DOCUMENTS

| | | | |
|---|---|---|---|
| 1,575,656 | 3/1926 | Stratford et al. . | |
| 2,258,343 | 10/1941 | Walker | 173/322 |
| 2,890,267 | 6/1959 | Forney, Jr. | 174/88 |
| 2,938,069 | 5/1960 | Toedtman et al. | 174/94 |
| 3,004,095 | 7/1962 | Buzak | 174/51 |
| 3,021,581 | 2/1962 | Cook et al. | 24/73 |
| 3,122,604 | 2/1964 | Cook et al. | 174/51 |
| 3,137,925 | 6/1964 | Wahl | 29/155.55 |
| 3,200,190 | 8/1965 | Forney, Jr. | 174/75 |
| 3,283,061 | 11/1966 | Bolling | 174/87 |
| 3,514,528 | 5/1970 | Ray | 174/84 |
| 3,699,504 | 10/1972 | Huber | 339/177 R |
| 3,877,112 | 4/1975 | Pestka | 24/73 |
| 4,397,516 | 8/1983 | Koren et al. | 339/177 R |
| 4,449,779 | 5/1984 | Hampshire | 339/177 R |

FOREIGN PATENT DOCUMENTS

| | | | |
|---|---|---|---|
| 853459 | 11/1960 | United Kingdom | 339/177 R |

*Primary Examiner*—Joseph H. McGlynn

*Attorney, Agent, or Firm*—Robert M. Rodrick; Salvatore J. Abbruzzese

[57] ABSTRACT

Apparatus for terminating an elongate, insulatively jacketed, shielded cable of type having a signal conductor and a drain wire, includes a member for receiving said cable therein and compressible onto the received cable to resist mutual longitudinal movement therebetween, the member providing longitudinal shielding for the cable, permitting passage of the signal conductor therethrough and defining exterior surface for disposition of the drain wire. A connector housing defines a channel for retentively receiving the compressible member with the cable therein, the housing including a deformable wall bounding the channel and responsive to deforming force applied thereto both for compressing the compressible member onto the cable and for electrically interconnecting the drain wire and the housing.

31 Claims, 8 Drawing Figures

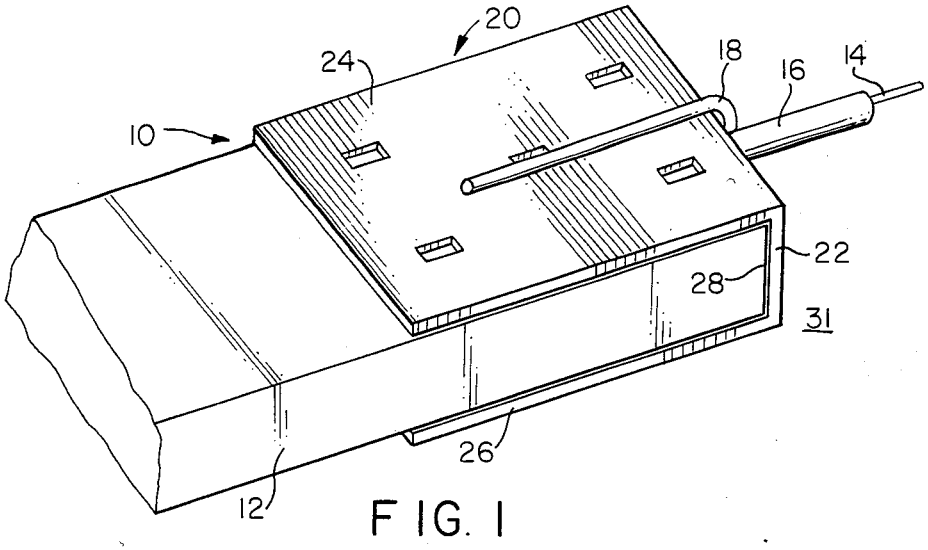
FIG. 1
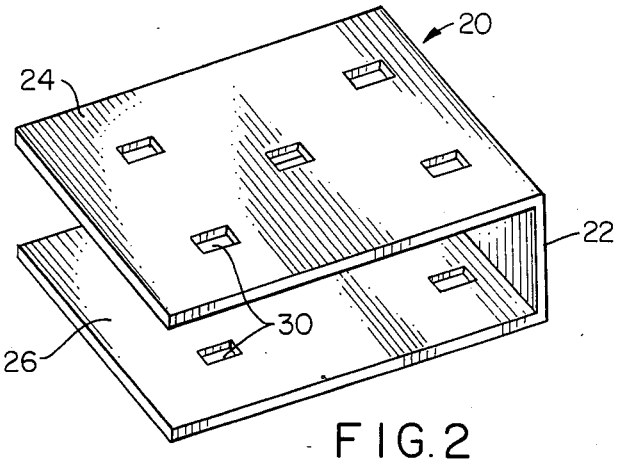
FIG. 2
FIG. 3
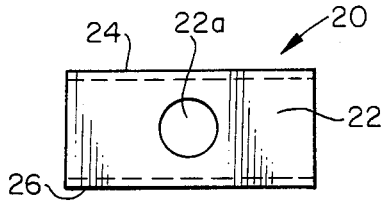

SHIELDED CABLE TERMINATION AND APPARATUS AND COMPONENTS THEREFOR

FIELD OF THE INVENTION

This invention relates generally to the termination of shielded cables and pertains more particularly to apparatus for terminating coaxial undercarpet data communication cables.

BACKGROUND OF THE INVENTION

Present day office planning increasingly looks to undercarpet placement of wiring for power distribution and telephone and digital data communication. In the digital data communication aspect, the art has accommodated digital signal transmission through the use of a jacketed coaxial cable of type having a center or signal conductor in circumscribing electrical insulation and further interiorly of a conductive shield (shield) having a drain wire electrically continuous therewith. In a product made commercially available by the assignee of the subject application, a coaxial cable is housed in resilient jacketing from which the cable is readily strippable for termination. The jacketing is in truncated pyramid cross-section, i.e., having sides tapering from a flat top part to the wider base seated on the floor of the installation. The jacketing accordingly protects the delicate coaxial cable and has outline suitable for aesthetic disposition beneath overlying carpeting.

When the coaxial cable is to be terminated, same is stripped from the jacketing, and the jacketing forwardly of the stripped cable is discarded, leaving the jacketing with an end face from which the center conductor and the drain wire protrude. Termination is then effected, i.e., the center conductor and drain wire are electrically connected directly to the signal input and ground terminals of a suitable user apparatus or to an intermediate connector, e.g., a pedestal to which the input cable of user apparatus may be releasably connected. Strain relief is desirably afforded, as by applying restraint to the cable jacketing.

In the case of terminating the cable with an intermediate connector, the drain wire has heretofore been terminated through connector structure discretely receiving same and limitations have accordingly arisen where cable drain wire diameter has exceeded the dimensions of such discretely dimensioned connector structure.

SUMMARY OF THE INVENTION

The present invention has as its primary object improved termination of shielded cables.

A more particular object of the invention is to provide improved apparatus for strain-relieved termination of coaxial cable.

A further specific object of the invention is to provide apparatus having readily assembled components for field installation of undercarpet data communication cable, irrespective of drain wire diameter thereof.

In attaining the foregoing and other objects, the invention provides apparatus for terminating an elongate, insulatively jacketed, shielded cable of type having a signal conductor and a drain wire, the apparatus having a member for receiving said cable therein and compressible onto the received cable to resist mutual longitudinal movement therebetween, the member providing longitudinal shielding for the cable, permitting passage of the signal conductor therethrough and defining seating surface for disposition of the drain wire. A connector housing defines a channel for receiving the compressible member with the cable therein, the housing including a deformable wall bounding the channel and responsive to deforming force applied thereto both for compressing the compressible member onto the cable and for electrically interconnecting the drain wire and the housing. Such compression further effects retention of the compressible member in the housing.

In its preferred form, the compressible member includes perforated arms which are compressed onto the cable jacketing to dispose jacketing selectively in the perforations to effect strain relief, i.e., such resistance to longitudinal movement between the cable and the compressible member. The channel extends longitudinally with the cable and the housing deformable wall bounds the channel and has first and second deformable webs extending from opposed transverse margins of the wall, a central part of the wall being of substantially greater thickness than the webs and displaced on web deformation, whereby the wall functions as above noted.

The foregoing and other objects and features of the invention will be further understood from the ensuing detailed description of the preferred embodiment and from the drawings wherein like reference numerals identify like parts throughout.

DESCRIPTION OF THE DRAWINGS

Fig. 1 is a perspective view of a jacketed coaxial cable resident in a compressible member in accordance with the invention.

FIG. 2 is a perspective view of the compressible member of FIG. 1.

FIG. 3 is an end elevation of the FIG. 2 compressible member.

DETAILED DESCRIPTION OF PREFERRED EMBODIMENTS

Figure 4:
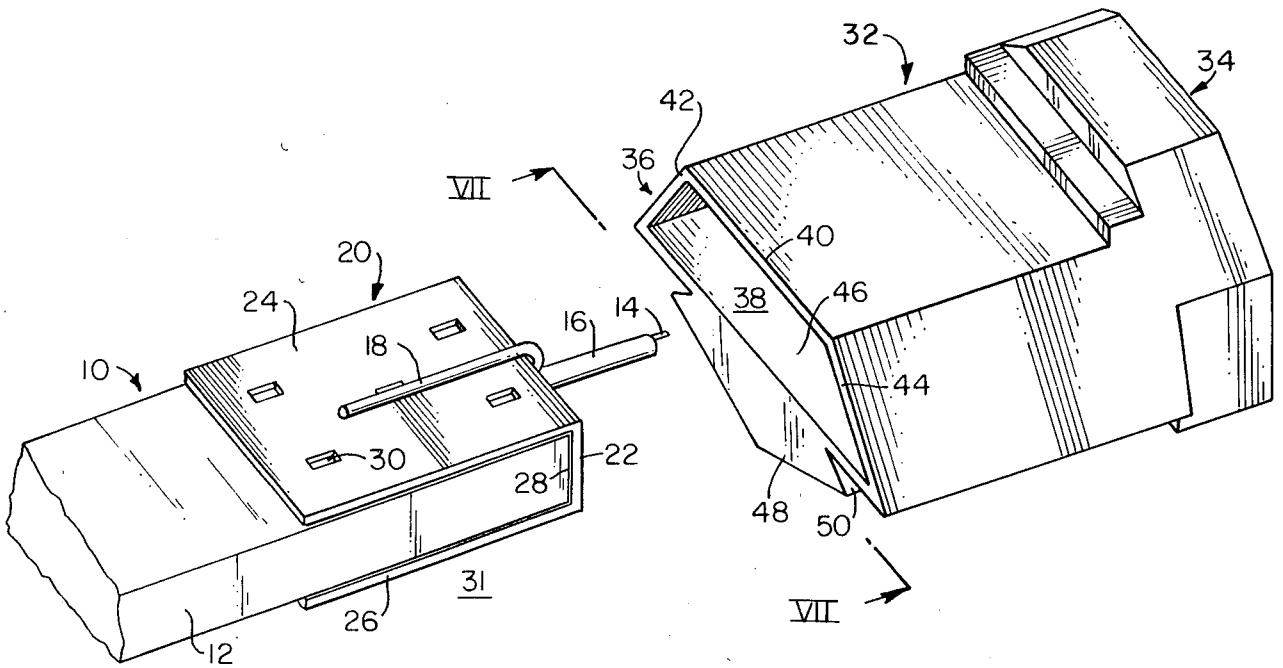
FIG. 4 is an exploded perspective view of the FIG. 1 subassembly and a connector housing in accordance with the invention.

Referring to FIGS. 1–3, elongate jacketed cable 10 has resilient jacketing 12, center or signal conductor 14 with insulation 16, drain wire 18 and shielding (not shown) which encircles conductor 14 and is electrically continuous with drain wire 18. A compressible member 20, shown in the form of a metal clip, has a central portion 22 and deflectable arms 24 and 26. Portion 22 has a central opening **22*a* therethrough permitting passage of signal conductor 14 and drain wire 18 and is juxtaposable with end face 28 of jacketing 12, cable 10 being prepared as above discussed, i.e., by cable stripping and discarding of jacketing. Arms 24 and 26 include perforations 30 therethrough for selective extruded receipt of jacketing 12 when member 20 is compressed upon cable 10, thereby to resist mutual longitudinal movement between cable 10 and member 20 and thus effect strain relief. Arm 24 defines exterior seating surface for drain wire 18, as shown in FIG. 1. Such seating does not look to discrete structure engaging a drain wire within diametric limits and accordingly accommodates any diameter drain wire. As will be appreciated by those skilled in the shielding art, center portion 22 of member 20 extends fully across cable end face 28 of jacketing 12, except for the conductor-occupied central opening 22***a* thereof and thus is effective as a shield to longitudinal propagation of radio-frequency (r-f) signals in the shielding of cable 10. Otherwise stated, r-f currents conducted along the cable shield will be coupled, either directly or reflected, to compressible member 20, which provides a low impedance path to the housing thereof, as shown below, reducing voltage drop and hence electromagnetic interference.

Subassembly 31 of Fig. 1 is shown in FIG. 4 in readiness for insertion in connector housing 32. Housing 32 is an elongate, electrically conductive body, of such composition as plated zinc, and includes a threaded open end 34 adapted for engagement with another connector housing to transmit signals of conductor 14 thereto. Opposite end 36 of housing 32 is also open and has a channel 38 extending longitudinally therein and bounded by walls 40, 42 and 44 of generally uniform first thickness, and a fourth wall 46, which is configured to be selectively deformable, as wil be discussed in connection with FIGS. 7 and 8 below.

Figure 5:
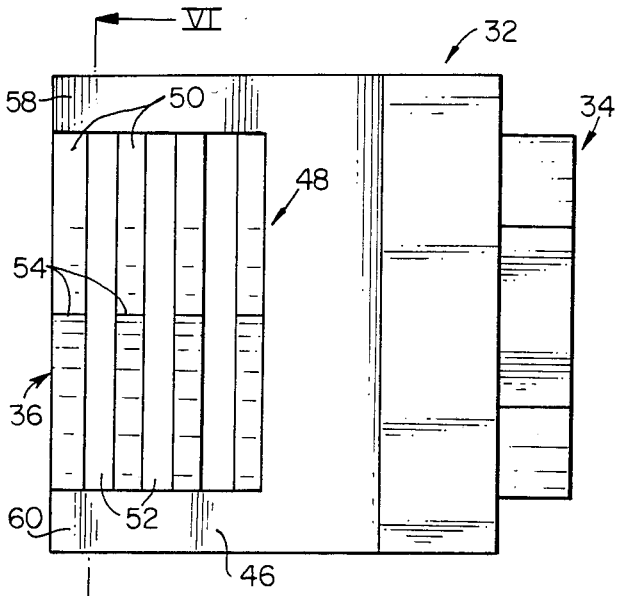
FIG. 5 is a bottom plan view of the connector housing of FIG. 4.
Figure 6:
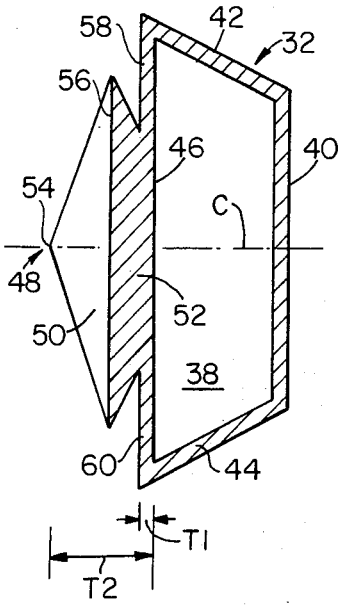
FIG. 6 is a sectional view of the connector housing as would be seen from plane VI—VI of FIG. 5.

Depending downwardly from housing 32 is a projection 48 of wall 46, generally of rhombic or diamond configuration in first transverse ribs 50, as shown in FIGS. 5 and 6. Second transverse ribs 52 are individually longitudinally successive to individual ones of ribs 50 and, conversely to the peaks 54 of ribs 50, have flat outermost surfaces 56. Webs 58 and 60 extend from opposed transverse margins of wall 46 to projection 48 and are of such first thickness T1, generally that of walls 40, 42 and 44. Projection 48, which may be termed a central part of deformable wall 46, is throughout of thickness substantially greater than that of webs 58 and 60 and such thickness distribution is, in the case of both ribs 50 and 52, symmetrical about a central axis C of wall 46. In the case of ribs 50, thickness thereof will be seen to increase from an outset thickness at the point of continuity with webs 58 and 60 (first thickness) to a second thickness T2 at the peaks or apices 54 thereof.

Given the configuration of ribs 50 and the spacing thereof by ribs 52, there is provided a readily locatable and grippable point contact surface along peaks 54 for one jaw of a low-leverage type pliers or other crimping tool and a continuous flat surface (wall 40) for the other jaw of the tool.

Figure 7:
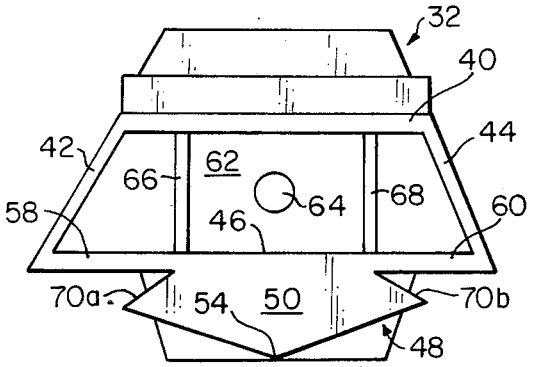
FIG. 7 is an end elevation of the connector housing as seen from plane VII—VII of FIG. 4.

Turning to FIG. 7, further structure of housing 32 is seen, i.e., insulator 62 with central opening 64 for egress of signal conductor 14 and vertical ribs 66 and 68, which provide stops for cable 10 by engagement with central portion 22 of compressible member 20.

Figure 8:
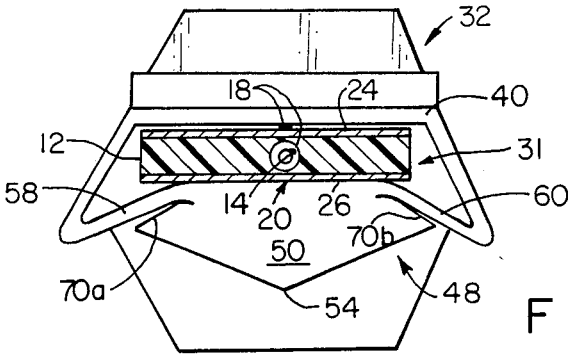
FIG. 8 is an end elevation of the connector housing with the subassembly of FIG. 1 resident therein and with the housing wall crimped onto the subassembly.

In FIG. 8, the completed assembly of subassembly 31 of FIG. 1 and housing 32 is depicted, the subassembly being shown in section. Crimping or other deformation force has now been applied as between peaks 54 and wall 40. Deformation of webs 58 and 60 has occurred to the limit of engagement thereof with undersurfaces 70*a* and 70*b* of ribs 50 and 52. Based on the configuration of wall 46, its interior surface has been advanced in substantial parallelism with wall 40 and arms 24 and 26 of member 20, effecting compression of member 20 onto cable 10, securement of member 20 in housing 32 and electrical interconnection of drain wire 18 with housing 32. A further consequence of the illustrated deformable wall configuration is the occurrence of a step change to the operator performing the crimping. Thus, in the course of yielding of webs 58 and 60, the operator senses movement of the deformable wall 46 essentially linearly with applied force and then absence of yielding when undersurfaces 70*a* and 70*b* engage ribs 50 and 52, despite increase in applied force. Otherwise stated, crimping force is applied to the crest of dependent structure 48 through the center of the housing, resulting in a uniform compression and material flow until engagement between undersurfaces 70*a* and 70*b* and ribs 50 and 52 occurs, at which point deformation of wall 46 toward wall 40 is substantially limited. It should be understood that at this limiting point, the spacing between deformed wall 46 and opposed wall 40 is of such dimension as to cause compression of member 20 onto cable 10 and compression of drain wire 18 between the member 20 and the housing 32.

In its various aspects, the invention will be seen to provide termination apparatus for coaxial cable in jacketing, to effect strain relief for such cable, to implement controlled housing deformation in such termination, to provide longitudinal r-f signal shielding in termination, and to provide a terminated connection readily receiving companion signal transmission connectors. Field use of the apparatus will be seen to be afforded based on the simplicity thereof, requiring no more than a common pliers or like crimping tool.

Various changes may be made to the foregoing without departing from the invention. The particularly described and illustrated preferred embodiment is thus intended in an illustrative and not in a limiting sense. The true scope of the invention is set forth in the following claims.

I claim:

1. Apparatus for terminating elongate, insulatively jacketed, shielded cable of the type having a signal conductor and a drain wire, comprising:

(a) a member for receiving said cable therein and compressible onto such received cable to resist mutual longitudinal movement therebetween, such compressible member providing longitudinal shielding for said cable, permitting passage of said signal conductor therethrough and defining seating surface for disposition of said drain wire; and (b) a connector housing defining a channel for retentively receiving such compressible member with said cable therein, said housing including deformable wall means bounding said channel and responsive to deforming force applied thereto both for compressing said compressible member onto said cable and for electrically interconnecting said drain wire and said housing.

2. The apparatus claimed in claim 1 wherein said compressible member is an electrically conductive element having a central portion juxtaposable with an end face of said cable jacketing and defining a passage therethrough for said signal conductor and said drain wire.

3. The apparatus claimed in claim 2 wherein said element further includes a pair of arms deflectable from said central portion into engagement with said cable jacketing.

4. The apparatus claimed in claim 3 wherein at least one of said arms includes perforations therethrough to selectively receive cable jacketing for such resistance of mutual longitudinal movement between said cable and said compressible member.

5. The apparatus claimed in claim 4 wherein said element is a metal clip having such perforations in both of said arms.

6. The apparatus claimed in claim 1 wherein said channel extends longitudinally with such received cable and wherein said housing wall means comprises a generally flat wall bounding said channel and including first and second deformable webs extending from opposed transverse margins thereof and of generally uniform first thickness and a central part extending between said webs and of substantially greater thickness than said first thickness.

7. The apparatus claimed in claim 6 wherein the thickness of said wall central part increases from said first thickness to a second thickness and then decreases from said second thickness to said first thickness.

8. The apparatus claimed in claim 7 wherein such central wall part thickness increase and decrease are symmetrical about a central axis of said wall.

9. The apparatus claimed in claim 8 wherein such central wall part includes longitudinally successive first and second portions respectively having flat and peaked outermost surfaces.

10. The apparatus claimed in claim 8 wherein said housing includes further another flat wall bounding said channel and spaced opposite said first-mentioned wall.

11. The apparatus claimed in claim 10 wherein such other flat wall is of generally uniform thickness.

12. The apparatus claimed in claim 11 wherein such thickness of said other flat wall is generally equal to said first thickness.

13. The apparatus claimed in claim 2 wherein said channel extends longitudinally with such received cable and wherein said housing wall means comprises a generally flat wall bounding said channel and including first and scond deformable webs extending from opposed transverse margins thereof and of generally uniform first thickness and a central part extending between said webs and of substantially greater thickness than said first thickness.

14. The apparatus claimed in claim 13 wherein the thickness of said wall central part increases from said first thickness to a second thickness and then decreases from said second thickness to said first thickness.

15. The apparatus claimed in claim 14 wherein such central wall part thickness increase and decrease are symmetrical about a central axis of said wall.

16. The apparatus claimed in claim 15 wherein such central wall part includes longitudinally successive first and second portions respectively having flat and peaked outermost surfaces.

17. The apparatus claimed in claim 15 wherein said housing includes further another flat wall bounding said channel opposite said first-mentioned wall.

18. The apparatus claimed in claim 17 wherein such other flat wall is of generally uniform thickness.

19. The apparatus claimed in claim 18 wherein such thickness of said other flat wall is generally equal to said first thickness.

20. The apparatus claimed in claim 6 wherein said compressible member is an electrically conductive element having a central portion juxtaposable with an end face of said cable jacketing and defining a passage therethrough for said signal conductor and said drain wire.

21. The apparatus claimed in claim 20 wherein said element further includes a pair of arms deflectable from said central portion into engagement with said cable jacketing.

22. The apparatus claimed in claim 21 wherein at least one of said arms includes perforations therethrough to selectively receive cable jacketing for such resistance of mutual longitudinal movement between said cable and said compressible member.

23. The apparatus claimed in claim 22 wherein said element is a metal clip having such perforations in both of said arms.

24. In combination:

(a) an elongate, insulatively jacketed, shielded cable having a signal conductor and a drain wire;

(b) a compressible member having said cable resident therein and compressed onto said cable to resist mutual longitudinal movement therebetween, such compressible member providing longitudinal shielding for said cable, providing passage of said signal conductor therethrough and defining exterior surface on which said drain wire is disposed; and (c) a connector housing defining a channel, said conductive member with said cable therein being retentively resident in said channel, said housing including deformed wall means bounding said channel and compressing said compressible member onto said cable and electrically interconnecting said drain wire and said housing.

25. The invention claimed in claim 24 wherein said compressible member includes a plurality of perforations therein, cable jacketing in registry with said perforations being resident therein and effecting such resistance to longitudinal movement between said compressible member and said cable.

26. The invention claimed in claim 24 wherein said housing wall means comprises a wall including first and second deformed webs extending from opposed transverse margins thereof and of generally uniform first thickness and a central part extending between said webs and of substantially greater thickness than said first thickness.

27. The invention claimed in claim 26 wherein said central wall part includes longitudinally successive first and second portions respectively having flat and pointed outermost surfaces.

28. The invention claimed in claim 27 wherein said central wall part is of symmetrical cross-section about a central axis of said wall.

29. Apparatus for terminating an elongate, insulatively jacketed, shielded cable of type having a signal conductor and a drain wire, comprising:

(a) a connector housing having a channel for retentively receiving said cable therein, said housing including wall means bounding said channel, said wall means being deformable in response to a force applied thereto, said housing further including means for limiting the deformation of said wall means upon application of a force greater than said applied force; and (b) means responsive to said applied force for causing retention of said cable in said connector housing.

30. The apparatus claimed in claim 29 wherein said means for causing retention of said cable in said connector housing comprises a compressible conductive member disposed on the insulative jacket of said cable, said conductive member having means for resisting longitudinal movement between said jacket and said conductive member, said conductive member having a surface thereon for receipt of said drain wire, said drain wire adapted to be compressed between said surface and said wall means of said connector housing upon application of said applied force.

31. The apparatus claimed in claim 29 wherein said limiting means comprises deformable webs of first thickness on said walls, said webs being separated by a wall of thickness greater than said first thickness, said wall having surfaces respectively spacedly opposing said webs, said webs adapted to deform upon an application of said applied force to said wall means, deformation continuing until said surfaces engage said webs whereby said deformation is substantially limited.

* * * * *